US006674010B2

(12) United States Patent
Inui

(10) Patent No.: US 6,674,010 B2
(45) Date of Patent: Jan. 6, 2004

(54) ELECTRONIC DEVICE CONNECTION CABLE AND ELECTRONIC DEVICE

(75) Inventor: Tsutomu Inui, Chiba-ken (JP)

(73) Assignee: Sony Computer Entertainment Inc. (JP)

( * ) Notice: Subject to any disclaimer, the term of this patent is extended or adjusted under 35 U.S.C. 154(b) by 0 days.

(21) Appl. No.: 10/094,071

(22) Filed: Mar. 8, 2002

(65) Prior Publication Data

US 2002/0177357 A1 Nov. 28, 2002

(30) Foreign Application Priority Data

Mar. 9, 2001 (JP) ..... 2001-067617

(51) Int. Cl.[7] ..... H01B 7/00
(52) U.S. Cl. ..... 174/113 R; 174/113 C
(58) Field of Search ..... 174/110 R, 113 R, 174/113 C, 116, 36

(56) References Cited

U.S. PATENT DOCUMENTS 5,268,676 A * 12/1993 Asprey et al. ..... 345/169
5,504,540 A * 4/1996 Shatas ..... 348/844
5,821,466 A * 10/1998 Clark et al. ..... 174/113 R
5,834,699 A * 11/1998 Buck et al. ..... 174/113 R
6,124,551 A * 9/2000 Mattos et al. ..... 174/113 R
6,128,117 A * 10/2000 Kim ..... 359/152
6,580,034 B2 * 6/2003 Daane et al. ..... 174/117 F

FOREIGN PATENT DOCUMENTS

EP 0182435 A2 5/1986
EP WO 98/287757 * 7/1998 ..... H01B/11/22
FR 2769120 A1 4/1999

* cited by examiner

*Primary Examiner*—William H. Mayo, III
(74) *Attorney, Agent, or Firm*—Lerner, David, Littenberg, Krumholz & Mentlik, LLP

(57) ABSTRACT

An electronic device connection cable includes a transmission part including 18 high-speed signal lines, 20 ground lines, and 22 low-speed signal lines. The electronic device connection cable further includes a tube-shaped sheath within which the transmission part is disposed such that the surface of the transmission part is covered with the sheath. The transmission part includes a first layer disposed at an outermost location, a second layer which is radially inwardly adjacent to the first layer, and a third layer which is radially inwardly adjacent to the second layer. In the first layer, 12 high-speed signal lines and 12 ground lines are alternately disposed. In the third layer, the remaining 6 high-speed signal lines and 6 ground lines are alternately disposed. In this structure, any two high-speed signal lines are not disposed at directly adjacent locations, and thus it is ensured that data can be transferred in a highly reliable fashion without being significantly influenced by noise.

7 Claims, 2 Drawing Sheets

ELECTRONIC DEVICE CONNECTION CABLE AND ELECTRONIC DEVICE

CROSS-REFERENCE TO RELATED APPLICATIONS

The present application claims priority from Japanese Application No. 2001-67617 filed Mar. 9, 2001, the disclosure of which is hereby incorporated by reference herein.

BACKGROUND OF THE INVENTION

The present invention relates to an electronic device connection cable having a plurality of high-speed signal lines, a plurality of ground lines, and a plurality of low-speed signal lines.

A video game device, an entertainment device, and similar electronic devices are practically used. One of those electronic devices includes a main unit including a central processing unit (CPU) and other electronic components disposed in a case. The electronic device has a controller connected to the main unit and controlled by a user.

Such an electronic device generally uses a storage device such as a flash memory. The storage device is generally provided in the form of a card that can be attached to the main unit of the electronic device.

Advanced electronic devices deal with a large amount of information and need a high-capacity storage device such as a hard disk drive (HDD). One technique to meet the above requirement is to connect a peripheral device serving as an external high-capacity storage device to the electronic device and use it instead of the card-type storage device having only limited storage capacity.

To connect such a peripheral device to the main unit of an electronic device, it is known in the art to use a cable and an interface according to a proper standard such as the ATA (AT Attachment) standard established by the American National Standards Institute (ANSI) or the SCSI (Small Computer System Interface) standard. Another standard for the interface between the main unit of an electronic device and the peripheral device is the UltraATA/66 (UltraDMA/66) standard. The interface according to this standard allows a connection at a rather high speed and at low cost.

In the UltraATA/66 standard, a connector for connecting electronic devices with each other includes 40 pins for data signal lines according to the ATA standard, and a transmission part (cable) includes 40 data signal lines connected to the respective pins and 40 ground lines that are disposed in correspondence with the respective signal lines so as to improve signal quality. The 40 ground lines and 40 data signal lines are alternately disposed in a single flat layer. That is, the cable according to this standard includes a total of 80 signal lines that are all disposed in the single flat layer.

However, in the UltraATA/66 standard, because the transmission part has a flat structure in which all signal lines are disposed parallel to one another in the same single layer, the outward appearance of the transmission part may not be good, and it may not be easy to bend the transmission part when it is connected to an electronic device. Similar problems may also occur in any flat-type cable according to standards other than UltraATA/66.

It is also known in the art to form a transmission part such that each pair of lines is formed by twisting together one data signal line and one ground line, and a plurality of twisted pairs are combined together into a bundle that is circular in cross section. However, in this type of transmission part, some portions of data signal lines are brought into proximity with one another. This may cause crosstalk noise to be generated among data signal lines, and thus this type of transmission part is not used in practical applications in which it is needed to transmit data signals at a high speed. Furthermore, twisting lines makes it difficult to bend the transmission part and thus it is not easy to handle it.

SUMMARY OF THE INVENTION

It is an object of the present invention to provide an electronic device connection cable that can transmit data between electronic devices without generating noise and that can be easily handled.

According to an aspect of the present invention, there is provided an electronic device connection cable including a transmission part including a plurality of high-speed signal lines and a plurality of ground lines; and a sheath disposed around the plurality of high-speed signal lines and the plurality of ground lines, wherein the plurality of high-speed signal lines and the plurality of ground lines are arranged such that no interference occurs among signals traveling through the plurality of high-speed signal lines.

Herein, the term "high-speed signal line" refers to a data signal line or the like for transferring data at a high speed in synchronization with a clock frequency to read or write the data. Interference between signals refers to a state in which a signal traveling through a signal line exerts so great an influence on a signal traveling through another signal line that the signal traveling through the another signal line is not transmitted correctly.

In an embodiment according to the invention, the high-speed signal lines and the ground lines are arranged so that no interference occurs among signals transmitted through the high-speed signal lines and noise due to crosstalk among the high-speed signal lines is suppressed to a very low level, thereby ensuring that data is transmitted between electronic devices in a highly reliable fashion.

Furthermore, unlike a flat-type cable that can be bent only along a line in the flat plane of the cable, the electronic device connection cable of the present invention can be easily bent in any desired direction because the electronic device connection cable is disposed within a sheath having the shape of a tube. This makes it possible to easily connect the electronic device connection cable to a device. Herein, the "tube" shape refers to a shape that is circular, elliptic, or a polygonal in cross section. Because the transmission part includes no twisted pairs of lines, the transmission part is soft enough to easily bend. This makes it possible to easily handle the transmission part.

Preferably, the transmission part includes a plurality of high-speed signal lines, a plurality of ground lines, and a plurality of low-speed signal lines arranged in a bundle, and the sheath is formed in the shape of a tube within which the bundle of signal lines and ground lines are disposed such that the outer surface of the bundle is covered with the sheath, wherein high-speed signal lines and ground lines are alternately arranged in an outermost layer in the transmission part. Herein, the term "low-speed signal line" refers to a data signal line used to transfer data, such as a signal for controlling an access indicator to indicate whether an electronic device is being accessed by another electronic device, at a rather low transfer rate.

In this structure in which high-speed signal lines and ground lines are alternately arranged, any two high-speed signal lines are not arranged at directly adjacent locations, and thus noise due to crosstalk among the high-speed signal lines is suppressed to a very low level, thereby ensuring that data is transferred between electronic devices in a highly reliable fashion. Furthermore, because the high-speed signal lines are disposed in the outermost layer of the transmission part where coupling among high-speed data signal lines is lower than in any other layer, noise due to crosstalk can be suppressed to a lower level than can be achieved when the high-speed signal lines are disposed in an inner layer.

Furthermore, because the sheath is formed so as to have the shape of a tube having no flat surface portion, the transmission part can be easily bent in any desired direction. This results in an improvement in ease of handling.

Preferably, the transmission part includes, in addition to the outermost layer described above, a second layer disposed radially inwardly adjacent to the outermost layer, and a third layer disposed radially inwardly adjacent to the second layer, wherein, in a case where the total number of high-speed signal lines included in the transmission part is greater than the number of high-speed signal lines that can be disposed in the outermost layer, high-speed signal lines that cannot be disposed in the outermost layer are disposed in the third layer such that high-speed signal lines and ground lines are arranged alternately.

In this structure in which the second layer is disposed between the outermost and third layers, because the third layer and the outermost layer are not disposed at directly adjacent locations and because, also in the third layer, high-speed signal lines and ground lines are arranged alternately, any two high-speed signal lines are not arranged at directly adjacent locations and thus noise due to crosstalk among the high-speed signal lines is suppressed to a very low level. Furthermore, because some of the high-speed signal lines are disposed in the third layer, the number of signal lines disposed in the outermost layer can be reduced, and thus the diameter of the transmission part can be reduced. This makes it possible to bend the transmission part more easily. Thus, the transmission part can be handled more easily.

Preferably, the high-speed signal lines include high-speed data signal lines and clock lines; and, in the outermost layer in the transmission part, high-speed data signal lines and ground lines are arranged alternately, wherein in a case in which there are a greater number of high-speed data signal lines than can be disposed in the outermost layer, high-speed data signal lines that cannot be disposed in the outermost layer are disposed in the third layer such that high-speed data signal lines and ground lines are arranged alternately. In this structure, crosstalk noise among the high-speed data signal lines is suppressed to a very low level when data is transferred through the high-speed data signal lines at a high transfer rate. This ensures high reliability in transferring of data.

Preferably, the transmission part includes 18 high-speed signal lines, 20 ground lines, and 22 low-speed signal lines. Herein, the ground lines are used to suppress crosstalk noise among the high-speed signal lines. Therefore, it is not needed to arrange a ground line between low-speed signal lines, because no significant crosstalk noise occurs among low-speed signal lines.

That is, this structure needs only 20 ground lines arranged alternately with the 18 high-speed signal lines. Thus, it is possible to arrange all high-speed signal lines such that any two high-speed signal lines are not located at directly adjacent positions using a minimized total number of signal lines. This makes it possible to form the transmission part so as to have a small diameter.

Preferably, the high-speed signal lines include 16 high-speed data signal lines and 2 clock lines. In this structure, it is possible to parallely transfer respective bits of 16-bit data using the 16 high-speed data signal lines.

DETAILED DESCRIPTION

The present invention is described in further detail below with reference to preferred embodiments in conjunction with FIGS. 1 and 2.

[Overall Structure of an Electronic Device]

Figure 1:
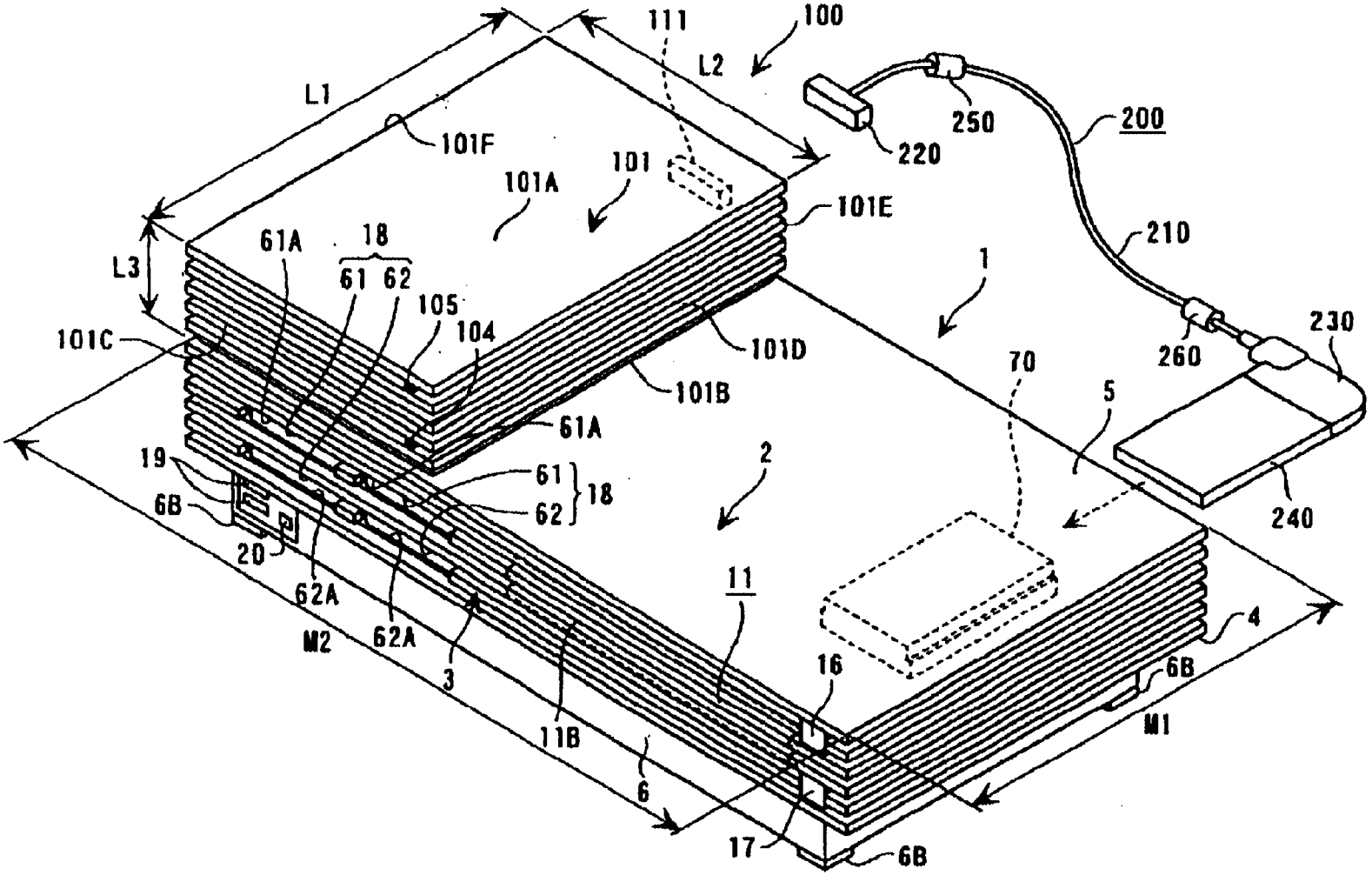
FIG. 1 is a perspective view illustrating an electronic device connection cable according to an embodiment of the present invention and an electronic device including a main unit and a peripheral unit that are connected to each other using the electronic device connection cable.

FIG. 1 is a perspective view of an electronic device according to an embodiment of the present invention. This electronic device includes an entertainment device 1 that is a main unit of the electronic device, a hard disk drive (HDD) 100 that is a peripheral unit of the electronic device, and an electronic device connection cable 200 connecting the entertainment device 1 and the hard disk drive 100 to each other.

The entertainment device 1 reads a game program stored on an optical disk or the like and executes it in accordance with a command issued by a user (game player). Herein, "execution of a game program" refers to an operation of controlling the progress of a game while controlling an image and a voice/sound.

[Construction of the entertainment device (Main Unit of the Electronic Device)]

The entertainment device 1 includes a main unit 2 and a case 3 in which the main unit 2 is disposed.

The main unit 2 includes a disk drive 11, a power supply unit (not shown), a mother board (not shown), and an input/output signal control board (not shown). The mother board includes a control system including a central processing unit (CPU) and peripheral devices thereof, a graphic system including an image processing unit for drawing an image, and a sound system including an audio processing unit for generating a musical sound or a sound effect.

The case 3 includes a center chassis 4 on which the main unit 2 is constructed, an upper case 5, and a lower case 6, wherein the center chassis on which the main unit 2 is constructed is disposed between the upper case 5 and the lower case 6. The case 3 has a rectangular shape when viewed from above and a shape similar to the letter "L" when viewed from the front side.

In FIG. 1, the disk drive 11 is disposed in the upper case 5, on a front and right side thereof (as viewed from front). The disk drive 11 is used to drive a storage medium such as a CD-ROM or a DVD-ROM on which an application program such as a video game program is stored. A front end portion of a disk tray 11B of the disk drive 11 is exposed at the front side of the case 3. At the right side of the disk tray 11B (as viewed from front), a power switch 16 serving as control means and a tray switch 17 for controlling the movement of the disk tray 11B into/out from the upper case 5 are disposed on the front panel.

Two slot units 18 are disposed in the upper case 5 on the left side thereof (as viewed from front) such that slots of the respective slot units 18 are exposed via the front panel. Each slot unit 18 includes a memory card insertion part 61 disposed at an upper location and a controller connection part 62 disposed at a lower location.

An external auxiliary storage device such as a memory card can be inserted into either one of the memory card insertion parts 61. Each memory card insertion part 61 has an insertion hole 61A in the form of a thin rectangle extending in a horizontal direction. A shutter (not shown) is disposed on each memory card insertion part 61 so as to protect connection terminals disposed inside the memory card insertion part 61.

Each controller connection part 62 provides an input/output terminal for inputting/outputting a signal. A connection terminal disposed at an end of a controller cable (not shown) extending from a controller (not shown) serving as a control device is connected to either one of controller connection parts 62. Each controller connection part 62 has an insertion hole 62A in the form of a thin rectangle extending in a horizontal direction, wherein lower corners are rounded while upper corners are not rounded. Rounding the lower corners of each insertion hole 62A prevents the connection terminals of the controller from being connected in an upside-down fashion by mistake. The insertion hole 62A has a shape different from the shape of the insertion hole 61A of the memory card insertion part 61 so that an external auxiliary storage device cannot be inserted into the wrong insertion hole 62A by mistake.

The provision of the two controller connection parts 62 allows two controllers to be connected to the entertainment device 1, thereby allowing two players to enjoy a fighting/competing game or the like. The result of an operation performed in accordance with a command issued from a controller connected to each controller connection part 62 is stored in an external auxiliary storage device inserted in the memory card insertion part 61 disposed above the controller connection part 62.

A PC card slot unit 70 is disposed in the upper case 5 at a rear and right (when viewed from front) side such that a slot of the PC card slot unit 70 is exposed via a rear panel. The PC card slot unit 70 is electrically connected to the mother board of the main unit 2. A PC card serving as a card-type peripheral unit according to the PCMCIA (Personal Computer Memory Card International Association) standard or the JEIDA (Japanese Electronic Industry Development Association) standard can be inserted into the PC card slot unit 70. When a PC card is inserted into the PC card slot unit 70, the PC card is electrically connected to the main unit 2. The PC card may have various functions. For example, the PC card may be capable of recognizing a signal according to the ATA standard, or may be capable of recognizing a LAN signal that allows a connection between computers.

The front panel of the lower case 6 is located at a position recessed from the front panel of the upper case 5, and the right side of the lower case 6 is located at a position recessed from the right side of the upper case 5. In other words, the width and the depth of the lower case 5 are smaller than those of the upper case 5, and thus the volume of the lower case 6 is smaller than that of the upper case 5. On the other hand, the left side (as viewed from front) of the lower case 6 is flush with the left side of the upper case 5. Thus, the case 3 having the center chassis 4 located at the center has an unsymmetrical overall shape.

In the lower case 6, two data transfer terminals 19 and two external device connection terminals 20 for connecting external devices are disposed such that their slots are exposed via the front panel of the lower case 6 on the left-hand side (as viewed from front). The data transfer terminals 19 are compliant with the IEEE (Institute of Electrical and Electronic Engineers)-1394 standard. An end of a cable, the other end of which is connected to a device such as a digital camera or a video deck, can be connected to the data transmission terminals 19 so that data such as video/audio data can be transferred from the digital camera or the video deck to the entertainment device 1. The two external device connection terminals 20 are compliant with the USB (Universal Serial Bus) standard. Various types of devices can be connected to either one of external device connection terminals 20. More specifically, examples of devices that can be connected to the external device connection terminals 20 include an input device such as a keyboard, a pointing device such as a mouse, a printing device such as a printer, and an external storage device using a magneto-optical disk, a magnetic medium, or the like.

An opening 6A in the form of a slit extending in a longitudinal direction of the lower case 6 is formed in the front panel of the lower case 6 so that cooling air is supplied into the inside of the entertainment device 1 via the opening 6A.

As shown in FIG. 1, the entertainment device 1 is placed such that the lower surface with a greatest area of the lower case 6 faces toward a plane on which the entertainment device 1 is placed. In order to prevent vibrations from being transmitted from the plane on which the entertainment device 1 is placed to the inside of the entertainment device 1, vibration isolators 6B made of rubber are disposed at proper locations on the lower surface of the lower case 6.

[Construction of the Peripheral Unit]

A peripheral unit such as a hard disk drive 100 is placed on the upper surface of the upper case 5 of the entertainment device 1, as shown in FIG. 1. The hard disk drive 100 includes a case 101 having the general shape of a box and a main part (not shown) disposed inside the case 101.

The main part of the hard disk drive includes, in the inside thereof, a circuit board (not shown) for controlling an operation of the hard disk drive and an operation of accessing to a peripheral device. The circuit board includes a male connector 111 having 40 pins according to the ATA standard.

The case 101 includes a first outer plate 101A and a second outer plate 101B, both having a flat rectangular shape and located at opposite positions. The case 101 further includes a third outer plate 101C, a fourth outer plate 101D, a fifth outer plate 101E, and a sixth outer plate 101F, wherein edges portions of the respective first and second outer plates 101A and 101B are connected via the third, fourth, fifth, and sixth outer plates 101C, 101D, 101E, and 101F. The outer plates 101A to 101F define an outer surface of the case 101. These outer plates 101A to 101F are firmly connected to one another with screws (not shown).

As shown in FIG. 1, in the state in which the hard disk drive 100 is placed on the entertainment device 1, the first outer plate 101A of the hard disk drive 100 is parallel with the upper surface of the upper case 5 of the entertainment device 1. The first outer plate 101A has a depth L1 equal to the depth M1 of the upper case 5 and has a front width L2 smaller than the with M2 of the upper case 5. The depth L1 of the first outer plate 101A is greater than the width L2.

The second outer plate 101B located opposite the first outer plate 101A serves as a bottom plate that directly faces a plane (the upper surface of the upper case 5 in the example shown in FIG. 1) on which the hard disk drive 100 is placed. As with the first outer plate 101A, the second outer plate 101B has a flat rectangular shape with a depth equal to L1 and a width equal to L2. Vibration-isolating protrusions (not shown) are formed at four corners on the lower surface of the second outer plate 101B. The vibration-isolating protrusions are constructed in the shape of a thin flat plate using a material such as rubber having the capability of damping vibrations, and fit into recesses (not shown) formed on the second outer plate 101B.

The third to sixth outer plates 101C to 101F are disposed such that they extend in a direction perpendicular to both the first outer plate 101A and the second outer plate 101B. The third outer plate 101C serves as a front panel of the case 101, wherein the third outer plate has a width equal to L3 and a length equal to L2. The length L2 is set to be greater than the width L3. On the third outer plate 101C, an access indicator 104 for indicating whether the hard disk drive 100 has been accessed by the central processing unit of the entertainment device 1 and a power indicator 105 for indicating whether the power is on or off are disposed at locations close to each other.

The access indicator 104 includes a mark and a lamp unit. The mark is formed on the surface 10 and the lamp unit is disposed in a hole 10A. The lamp unit includes a transparent acrylic member embedded in the hole 10A and a lamp such as a light emitting diode disposed inside the case 101 such that the transparent acrylic member is illuminated with light emitted from the lamp.

The power indicator 105 also includes a mark and a lamp unit. The mark is formed on the surface 10, and the lamp unit is disposed in a hole 10A. As with the lamp unit of access indicator 104, the lamp unit of power indicator 105 includes a transparent acrylic member and a lamp.

The fourth outer plate 101D extends in a direction perpendicular to the third outer plate 101C. The fourth outer plate 101D has a with equal to L3 and a length equal to L1, wherein the length L1 is greater than the width L3.

The fifth outer plate 101E extends in a direction perpendicular to the fourth outer plate 101D and parallel with the third outer plate 101C. The fifth outer plate 101E has a width equal to L3 and a length equal to L2. Although not shown in FIG. 1, a power switch and a power terminal via which DC power is supplied from an AC adapter are disposed on the fifth outer plate 101E. The male connector 111 described above is exposed via the fifth outer plate 101E.

The sixth outer plate 101F extends in a direction parallel with the fourth outer plate 101D and perpendicular to the outer plates 101A, 101B, 101C, and 101E. The sixth outer plate 101F has a width equal to L3 and a length equal to L1.

[Construction of the Electronic Device Connection Cable]

The electronic device connection cable 200 according to an embodiment of the present invention includes a main part 210 having a circular shape in cross section, a first female connector 220 disposed on an end of the main part 210 of the cable, and a second female connector 230 disposed on the other end of the main part 210 of the cable. Near the first female connector 220, a ferrite core 250 is disposed on the main part 210 of the cable. On the other hand, a ferrite core 260 is disposed on the main part 210 of the cable near the second female connector 230. Those ferrite cores 250 and 260 serve as noise filters. The second female connector 230 is connected to a PC card 240.

The first female connector 220 has 40 pins. These pins are compliant with the UltraATA/66 standard so that the first female connector 220 can be connected with the male connector 111 of the hard disk drive 100.

The second female connector 230 connectable to a PC card 240 has a shape, in cross section, similar to the letter "L". In this structure, the axial direction of the main part 210 of the cable is perpendicular to a direction in which the PC card 240 connected with the second female connector 230 is inserted into the entertainment device 1. This makes it possible to easily connect the hard disk drive 100 to the entertainment device 1 without causing the main part 210 of the cable to have undesirable slack. The PC card 240, which is capable of recognizing signals according to the UltraATA/66 standard, is inserted into the PC card slot unit 70 when it is used.

Figure 2:
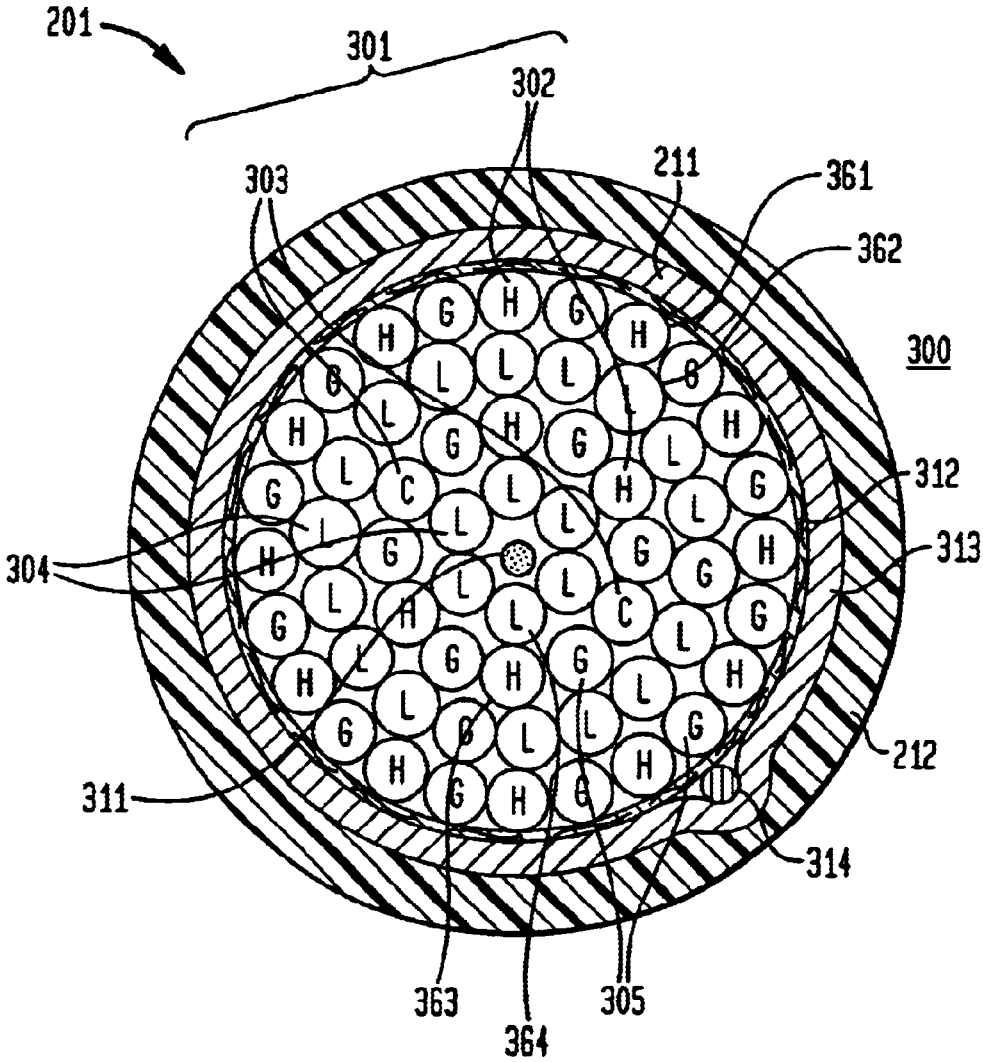
FIG. 2 is a cross-sectional view illustrating a transmission part of the electronic device connection cable.

FIG. 2 is a cross-sectional view of the main part 210 of the cable. The main part 210 of the cable is circular in cross section and includes a transmission part 211 and a tube-shaped sheath 212, wherein the surface of the transmission part 211 is covered with the sheath 212.

The transmission part 211 includes an interleaving fiber core 311 located at the center of the transmission part 211, a bundle 300 of 60 signal lines that are substantially equal in diameter to each other and that are uniformly disposed around the interleaving fiber core 311, a tape 312 disposed around the bundle 300 of signal lines, a woven metal shield 313 disposed outside the tape 312, and a drain wire 314 serving as a ground wire disposed between the tape and the woven metal shield 313. The sheath 212 described above is made of a resin. The outer surface of the woven metal shield 313 is covered with the resin sheath 212.

The bundle 300 of signal lines includes high-speed signal lines 301, including 16 high-speed data signal lines 302 (denoted by "H" in circles in FIG. 2) and 2 clock lines 303 (denoted by "C" in circles in FIG. 2), 22 low-speed signal lines 304 (denoted by "L" in circles in FIG. 2), and 20 ground lines 305 (denoted by "G" in circles in FIG. 2). Each of the signal lines 302 to 305 includes a conductive wire located at the center thereof, covered with an insulating material.

The tape 312 is made of paper. The tape 312 is helically wound around the bundle 300 of signal lines so as to combine the signal lines 302 to 305 into a single bundle. The tape 312 is wound tightly enough to prevent the signal lines 302 to 305 from shifting from their original positions.

The woven metal shield 313 is produced by weaving thin conductive wires into the form of a mesh. The bundle 300 of signal lines is covered with the woven metal shield 313 to prevent generation of noise.

The main part 210 of the cable can be regarded as having a structure obtained by removing 20 ground lines from a transmission part which includes 80 signal lines according to the ATA standard, and combining the remaining 60 lines 302 to 305, including 20 ground lines 305 and 40 data signal lines 302 to 304, into a bundle. At both ends of the main part 210 of the cable, the 40 data signal lines are connected to the 40 ATA-compliant pins of the respective female connectors 220 and 230. That is, the female connectors 220 and 230 located at the respective ends include pins corresponding to the 40 data signal lines 302 to 304.

The 16 high-speed data signal lines 302 are used to parallely transfer respective bits of 16-bit data in synchronization with a clock frequency that will be described later. This allows data to be transmitted at a higher rate than can be done by serial transmission.

The two clock lines 303 are used to transfer a clock signal (clock frequency) generated by a clock generator disposed on the mother board of the entertainment device 1. The 22 low-speed signal lines 304 are used to transfer data, such as a signal for controlling the access indicator 104 to indicate whether the hard disk drive 100 is being accessed, at a rather low transmission rate between the entertainment device 1 and the hard disk drive 100.

The manner of disposing the signal lines 302 to 305 is described below. As shown in FIG. 2, signal lines 302 to 305 are disposed in a bundle 300 so as to have the overall shape of a circle in cross section. In this bundle 300, the respective signal lines 302 to 305 are disposed at substantially symmetrical locations in cross section. The bundle 300 of signal lines has a multilayer structure in which the signal lines 302 to 305 are disposed. In each layer, signal lines are annularly disposed. In the present embodiment, signal lines are disposed in respective layers such that each layer extends along a circumference. Preferably, the respective layers extend along corresponding circumferences of concentric circles.

The bundle 300 of signal lines includes a first layer 361 at an outermost location in which 24 signal lines are disposed, a second layer 362 which is radially inwardly adjacent to the first layer 361 and in which 18 signal lines are disposed, a third layer 363 which is radially inwardly adjacent to the second layer 362 and in which 12 signal lines are disposed, and a fourth layer 364 which is radially inwardly adjacent to the third layer 363 and in which six signal lines are disposed.

The first layer 361 includes a total of 24 signal lines including 12 high-speed data signal lines 302 and 12 ground lines 305 which are alternately disposed. More specifically, in the first layer 361, a high-speed data signal line 302 is disposed at the top in FIG. 2, and a ground line 305, a high-speed data signal line 302, a ground line 305, a high-speed data signal line 302 and so on are disposed in a clockwise direction from the high-speed signal line 302 at the top.

The second layer 362 includes a total of 18 signal lines including 16 low-speed signal lines 304 and two ground lines 305 which are alternately disposed. More specifically, a low-speed signal line 304 is disposed inwardly adjacent to the high-speed data signal line 302 at the top in FIG. 2, and four low-speed signal lines 304, a ground line 305, four low-speed signal lines 304, a ground line 305, and seven low-speed signal lines are disposed in the clockwise direction from the low-speed signal line 304 at the top.

The third layer 363 includes a total of 12 signal lines including six high-speed signal lines 301, including four high-speed data signal lines 302 and two clock lines 303, and six ground lines 305 which are alternately disposed. More specifically, in the third layer 363, a high-speed data signal line 302 is disposed radially inwardly adjacent to the low-speed signal line 304 that is disposed inwardly adjacent to the high-speed data signal line 302 at the top in FIG. 2, and a ground line 305, a high-speed data signal line 302, a ground line 305, a clock line 303, a ground line 305, a high-speed data signal line 302, a ground line 305, a high-speed data signal line 302, a ground line 305, a clock line 303, and a ground line 305 are disposed in the clockwise direction from the high-speed data signal line 302 at the top.

The fourth layer 364 includes a total of six low-speed signal lines 304 disposed around the core 311.

The present embodiment provides the following advantages:

(1) The first layer 361 in which high-speed data signal lines 302 and ground lines 305 are alternately disposed, and the third layer 363 in which high-speed signal lines 301 and ground lines 305 are alternately disposed, are disposed at layer locations that are not directly adjacent to each other, thereby preventing any two high-speed signal lines 301 from being located directly adjacent each other and thus preventing noise due to crosstalk. This ensures that data can be transmitted between the entertainment device 1 and the hard disk drive 100 in a highly reliable fashion at a data transfer rate defined in the UltraATA/66 standard.

(2) Coupling among high-speed data signal lines 302 is lowest in the first layer 361. This means that noise due to crosstalk among high-speed data signal lines 302 in the first layer is lower than in any other inner layer such as the second layer 362. Therefore, if the first layer 361 is preferentially allocated to high-speed data signal lines 302, the overall signal transfer quality can be improved. This ensures that data can be transferred at a high transfer rate in a highly reliable fashion.

(3) The number of signal lines that can be disposed in the first layer 361 depends on the diameter of the main part 210 of the cable. In the present embodiment, in order to achieve low crosstalk noise while minimizing any increase in the diameter of the main part 210 of the cable, the number of high-speed data signal lines 302 disposed in the first layer 361 is limited to 12. This allows the main part 210 of the cable to have a smaller diameter than would be needed to dispose all 16 high-speed signal lines 302 in the first layer 361, and thus the main part 210 can be easily handled.

(4) In the present embodiment, unlike the flat-type transmission part according to the UltraATA/66 standard which can be bent only in a particular direction, the main part 210 of the cable is formed to be circular in cross section, and thus it can be easily bent in a desired arbitrary direction when it is connected between the entertainment device 1 and the hard disk drive 100. That is, the main part 210 of the cable according to the present embodiment can be easily handled.

(5) In the main part 210 of the cable according to the present embodiment, low noise similar to that achieved by a transmission part using 80 signal lines according to the UltraATA/66 standard can be achieved using 60 signal lines 302 to 305, the number of which is smaller by 20 than the number of signal lines according to the UltraATA/66 standard. The reduction in the number of total signal lines results in a reduction in the diameter of the main part 210 of the cable, which results in improvements in portability and ease of use.

(6) The female connectors 220 and 230 of the cable 200 are in accordance with the UltraATA/66 standard so that data can be transferred at a rate of 66.7 Mbps according to the UltraATA/66 standard. This data transfer rate is much higher than a data transfer rate of 33.3 Mbps most commonly employed in the conventional techniques.

(7) The second female connector 230 is formed so as to have a shape similar to the letter "L" in cross section, thereby allowing the PC card 240 to be inserted in a direction perpendicular to the axial direction of the main part 210 of the cable and thus allowing the entertainment device 1 and the hard disk drive 100 to be easily connected to each other without producing undesirable slack of the main part 210 of the cable at the rear of the entertainment device 1.

Although the present invention has been described above with reference to preferred embodiments, the invention is not limited to those embodiments. Various modifications and improvements are possible without departing from the spirit and scope of the present invention. For example, although two ferrite cores 250 and 260 are used in the embodiments described above, an arbitrary number of ferrite cores may be used. The ferrite cores are not necessarily needed if noise can be suppressed to a sufficiently low level without using the ferrite cores. Furthermore, the drain wire 314 used in the embodiments described above may be removed if similar effects can be achieved using other means such as the ground lines 305. In the embodiments described above, an interleaving core 311 made of fiber and a tape 312 made of paper are employed. Alternatively, they may be formed of different materials.

Furthermore, in the embodiments described above, 12 high-speed data signal lines 302 and 12 ground lines 305 are alternately disposed in the first layer 361. Instead, for example, 18 high-speed signal lines 301 and 18 ground lines 305 may be alternately disposed. The number of signal lines disposed in the first layer 361 is not limited to a particular value but may be set to an arbitrary value taking into account the size of the main part 210 of the cable and the noise that is generated, as long as high-speed signal lines 301 and ground lines 305 are alternately disposed.

In the embodiments described above, the clock lines 303 are disposed in the third layer 362. Alternatively, the clock lines 303 may be disposed in the first layer 361. However, it is more preferable to dispose the clock lines 303 in the third layer 362 in that less noise is generated among high-speed data signal lines 302 through which data is transferred at a high transfer rate.

In the embodiments described above, two ground lines 305 are disposed at particular locations in the second layer 362. Instead, they may be located at other locations in the second layer 362 or in the fourth layer 364.

The locations at which the high-speed signal lines 301 and the ground line 305 are disposed in the first layer 361 and the third layer 363 are not limited to those employed in the embodiments described above. The locations of other signal lines 303 and 304 may be arbitrarily selected, as long as the signal lines 301 and 305 are alternately disposed.

In the embodiments described above, the signal lines 302 to 305 are combined together into a bundle 300 that is circular in cross section such that the signal lines 302 to 305 are disposed at substantially symmetrical locations. Instead, the signal lines 302 to 305 may be combined together into a bundle that is elliptical in cross section. That is, what is essential is to combine together the signal lines 302 to 305 into a single bundle 300 that is not flat in cross section. However, the arrangement of the signal lines 302 to 305 employed in the embodiments described above is more advantageous in that the main part 210 of the cable can be formed so as to have a smaller size and to make it easier to use the cable.

In the embodiments described above, a total of 20 ground lines 305 are employed. A greater number of ground lines 305 may be used, as long as the resultant increase in the size of the main part 210 of the cable does not cause the main part 210 of the cable to become too difficult to handle.

In the embodiments described above, a total of 16 high-speed data signal lines 302 are used. Instead, the number of high-speed data signal lines 302 may be set to an arbitrary value such as 32, for example, in response to a revision of the interface standard to an up-graded version. When the number of high-speed data signal lines is modified, the numbers of low-speed signal lines 304 and ground lines 305 may also be modified as required. The numbers of respective signal lines may also be selected so as to meet any other cable standard.

In the embodiments described above, the female connector 220 is disposed on an end of the electronic device connection cable 200 so that the female connector 220 can be connected with the male connector 111 disposed on the hard disk drive 100. Alternatively, one end of the electronic device connection cable 200 may be connected directly to the hard disk drive 100.

In the embodiments described above, the electronic device connection cable 200 is used to connect external electric devices with each other. The electronic device connection cable 200 may also be used to connect internal parts located inside an electronic device with each other. However, the electronic device connection cable 200 is very advantageous in particular when it is used to connect external electronic devices with each other, because the electronic device connection cable 200, which is formed to be circular in cross section and which can be easily handled, can be used to connect devices regardless of where the devices are placed depending on the situation in which the devices are used.

In the embodiments described above, the electronic device connection cable 200 is used for connection with the hard disk drive 100. The electronic device connection cable 200 may also be used for connection with other types of electronic devices capable of recognizing other types of digital data, such as a CD-ROM drive, a DVD (Digital Versatile Disk) drive, a CD-RW (CD-Rewritable) drive, or a digital tuner.

In the embodiments described above, the high-speed data signal lines 302 and the ground lines 305 are alternately disposed in the first layer 361. Instead, for example, a low-speed signal line 304 or a string-shaped spacer may be disposed between two high-speed data signal lines 302. Alternatively, two or more ground lines 305 may be disposed at successive adjacent locations. That is, what is essential is to dispose signal lines such that no interference occurs among signals traveling through the high-speed data signal lines 302.

In the embodiments described above, the sheath 212 is formed so as to have a tube shape. Alternatively, the sheath 212 may be formed into another shape such as a polygon in cross section. That is, what is essential is that the sheath 212 can combine together the signal lines 302 to 304 and the ground lines 305 into a single bundle such that the surface of the resultant bundle is covered with the sheath 212.

In the embodiments described above, the second female connector 230 is formed so as to have a shape similar to the letter "L" in cross section. Alternatively, the second female connector 230 may be formed into another shape such as a straight shape as required.

As described above, the electronic device connection cable according to any embodiment of the present invention makes it possible to transfer data between electronic devices without encountering significant crosstalk noise due to interference among signals traveling through high-speed signal lines. Furthermore, unlike a flat-type cable that can be bent only along a line in the flat plane of the cable, the electronic device connection cable according to any embodiment of the present invention can be easily bent in a desired arbitrary direction, because the electronic device connection cable is disposed within a sheath having the shape of a tube. This makes it possible to easily connect the electronic device connection cable to a device.

The electronic device connection cable, according to one of the embodiments of the present invention, comprises a plurality of signal lines including one or more high-speed signal lines and at least either a ground line or a low-speed signal line. The signal lines are disposed in a multilayer structure including two or more layers. The multilayer structure includes a layer including one or more high-speed signal lines and a layer including no high-speed signal lines, wherein the layer including one or more high-speed signal lines and the layer including no high-speed signal lines are located adjacent each other. Preferably, in the layer including one or more high-speed signal lines, the high-speed signal lines and the ground lines are alternately disposed, or the high-speed signal lines and the ground lines or low-speed signal lines are alternately disposed.

In each layer, signal lines may be annularly disposed. Preferably, the layer including the high-speed signal lines is disposed at an outermost location in the multilayer structure.

The multilayer structure may include a first layer disposed at an outermost location and including a high-speed signal line; a second layer disposed inwardly adjacent the first layer and including no high-speed signal line; and a third layer disposed inwardly adjacent the second layer and including a high-speed signal line.

The data cable, according to one of the embodiments of the present invention, includes a plurality of signal lines including a high-speed signal line, a ground line, and a low-speed signal line. The signal lines are disposed in a multilayer structure including at least two layers. The multilayer structure includes a layer including high-speed signal lines in which the high-speed signal lines and ground lines or low-speed signal lines are alternately disposed; and a layer including no high-speed signal lines, wherein the layer including one or more high-speed signal lines and the layer including no high-speed signal lines are located adjacent each other. Preferably, in each layer, signal lines are annularly disposed. The layer including the high-speed signal lines may be disposed at an outermost location in the multilayer structure.

What is claimed is:

1. An electronic device connection cable, comprising:

a transmission part including a plurality of high-speed signal lines, a plurality of low-speed signal lines and a plurality of ground lines, the transmission part having a plurality of concentric layers, an outermost one of the layers including at least some of the plurality of high-speed signal lines arranged in alternating relationship with at least some of the plurality of ground lines, the plurality of high-speed signal lines being arranged so that one high-speed signal line in the outermost layer is not directly adjacent another high-speed signal line in the outermost layer; and a sheath disposed around the plurality of high-speed signal lines and the plurality of ground lines, wherein the plurality of high-speed signal lines and the plurality of ground lines are arranged such that no interference occurs among signals traveling through the plurality of high-speed signal lines.

2. An electronic device connection cable according to claim 1, wherein the plurality of layers includes:

a second layer disposed radially inwardly adjacent to the outermost layer; and a third layer disposed radially inwardly adjacent to the second layer, wherein a remainder of the plurality of high-speed signal lines are arranged in the third layer in alternating relationship with others of the plurality of ground lines.

3. An electronic device connection cable according to claim 2, wherein the high-speed signal lines include high-speed data signal lines and at least one clock line, wherein at least some of the high-speed data signal lines are disposed in the outermost layer.

4. An electronic device connection cable according to claim 3, wherein a remainder of the high-speed data signal lines are disposed in the third layer.

5. An electronic device connection cable, comprising:

a plurality of signal lines including at least two high-speed signal lines and at least one signal line selected from the group consisting of a ground line and a low-speed signal line;

the plurality of signal lines being disposed in a multilayer structure including at least inner layer and an outer layer, the inner layer being located adjacent to the outer layer; and the plurality of signal lines being arranged so that one high-speed signal line is not directly adjacent another high-speed signal line.

6. An electronic device connection cable according to claim 5, wherein one of the high-speed signal lines is disposed in the outer layer, and the at least one signal line is disposed in the inner layer.

7. An electronic device including a main unit, a peripheral unit, and a connection cable for connecting the peripheral unit to the main unit, the connection cable comprising:

a plurality of signal lines including at least two high-speed signal lines and at least one signal line selected from the group consisting of a ground line and a low-speed signal line;

the plurality of signal lines being disposed in a multilayer structure including at least inner layer and an outer layer, the inner layer being located adjacent to the outer layer; and the plurality of signal lines being arranged so that one high-speed signal line is not directly adjacent another high-speed signal line.

* * * * *

UNITED STATES PATENT AND TRADEMARK OFFICE

CERTIFICATE OF CORRECTION

PATENT NO. : 6,674,010 B2
DATED : January 6, 2004
INVENTOR(S) : Tsutomu Inui

It is certified that error appears in the above-identified patent and that said Letters Patent is hereby corrected as shown below:

Column 14,
Line 20, insert -- an -- before “inner”.
Line 38, insert -- an -- before “inner”.

Signed and Sealed this

Sixteenth Day of March, 2004

JON W. DUDAS
*Acting Director of the United States Patent and Trademark Office*